United States Patent [19]

Bennet

[11] 4,025,753

[45] May 24, 1977

[54] YARN HEATERS

[75] Inventor: Geoffrey Robert Bennet, Fleckney, England

[73] Assignee: Heating Elements Limited, England

[22] Filed: June 2, 1975

[21] Appl. No.: 582,934

[30] Foreign Application Priority Data

June 4, 1974 United Kingdom ..... 24742/74

[52] U.S. Cl. ..... 219/388; 28/62; 57/34 HS; 165/105; 219/341; 219/530; 432/59

[51] Int. Cl.² ..... H05B 1/00; D02J 13/00; F26B 13/02; F27B 9/28

[58] Field of Search ..... 219/388, 341, 530, 540, 219/326, 388 S, 388 W, 388 R; 165/105, 104; 28/62; 432/8, 59; 57/34 HS; 34/151, 152

[56] References Cited

UNITED STATES PATENTS

| | | | |
|---|---|---|---|
| 1,661,281 | 3/1928 | Bilan | 219/341 |
| 2,060,795 | 11/1936 | Burke | 219/341 |
| 2,874,410 | 2/1959 | Kinney | 28/62 |
| 3,395,433 | 8/1968 | Kodaira et al. | 28/62 |
| 3,396,524 | 8/1968 | Parker | 28/62 X |

*Primary Examiner*—A. Bartis
*Attorney, Agent, or Firm*—Larson, Taylor and Hinds

[57] ABSTRACT

A yarn heater has an elongate, hollow metal yarn heating member with a substantially constant internal cross-section, an electric yarn heating element mounted externally of the heating member and a baffle located internally inside of the heating member extending longitudinally therein and dividing the inside space into two passageways. The heating member is filled with a heating fluid which when heated by the heating element consists of a liquid phase and a vapor phase. Located at the lower end of the baffle is an aperture for permitting automatic circulation of the heating fluid. A yarn heating surface located at the front of the heating member and extending along the length thereof is formed with a pair of longitudinal grooves for guiding the yarn.

3 Claims, 8 Drawing Figures

YARN HEATERS

The invention relates to yarn heaters for use in textile manufacture, for example the drawing or crimping of yarns.

BACKGROUND OF THE INVENTION

Yarn heating members may be heated indirectly by an electric heating element using a heating fluid as intermediate. The heating fluid will establish a saturated vapour phase under operating conditions so that any cooling of the yarn heating member is followed immediately by cooling and local condensation with an attendant release of heat. Yarn heaters may be of a generally elongate shape and be used in arrays with individual heaters arranged upright. High yarn speeds are possible if the heaters heat the yarns over a sufficiently long path.

Difficulties arise in applying yarn heating members heated by heating fluid to elongate upright yarn heaters. Temperature variations may occur at the top and bottom of the yarn heaters. The temperature may vary to give a permanent temperature gradient or oscillate.

It is the purpose and object of the invention to reduce such temperature variations, without unduly increasing the dimensions of the yarn heaters or reducing the length over which yarn can be controllably heated.

SUMMARY OF THE INVENTION

According to this invention there is provided a yarn heater including an elongate hollow yarn heating member, a heating fluid for sealing inside the member, a heating element for heating of the liquid phase of the fluid at a lower part of the member, a yarn heating surface formed along the member for transmitting heat from the fluid to a yarn passing over the surface, and a baffle extending upwardly inside the lower part of the member but forming an aperture with the member at the lower end to permit circulation of liquid.

Suitably a vessel is provided at an upper part of the member communicating with the interior of the member for retaining gaseous impurities away from the heating surface.

Preferably the baffle is spaced by spacer devices from the interior walls of the member and the baffle permits passage of liquid from the front of the baffle to the back only through the aperture.

Using such a heater the heating fluid may be evaporated by the heating element behind the baffle. The passage of yarn leads to condensation of the fluid on the wall of the member adjacent the heating surface. The condensed fluid flows down in front of the baffle. In this way the fluid can be circulated and local temperature build-ups adjacent the heating element on the heating surface can be reduced or avoided. Advantageously the heater further includes a pair of grooves in the heating surface, insulating material around the member except for the heating surface and a removable lid for covering the heating surface except for the grooves. Suitably also the baffle is adapted to provide a flow area in front of the baffle smaller than that behind the baffle to encourage a relatively rapid flow past the heating surface. The ratio of the cross-sectional areas defined by the baffle and the heating member in front of and behind the baffle is advantageously 4:6. Suitably the baffle is of a resilient metal and inserted to achieve a tight fit with the inner walls of the heating member, the resiliency urging the baffle against the inner walls. In this way leakage of fluid past the baffle may be reduced.

The invention is more particularly described with reference to the drawings in which.

Figure 3:
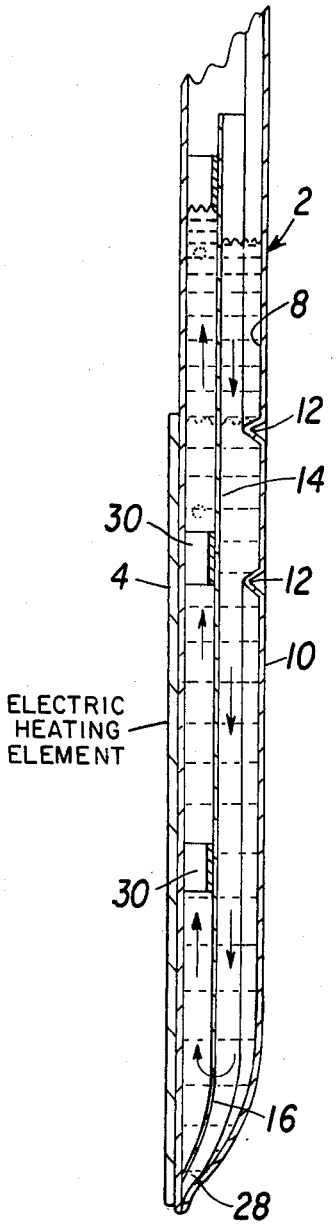
FIG. 3 is a longitudinal section of a lower part of the yarn heating member of FIG. 1 in operation.
Figure 4:
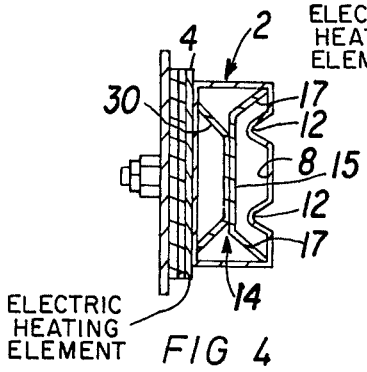
FIG. 4 is a cross-section through another yarn heating member of a yarn heater according to the invention.
Figure 2:
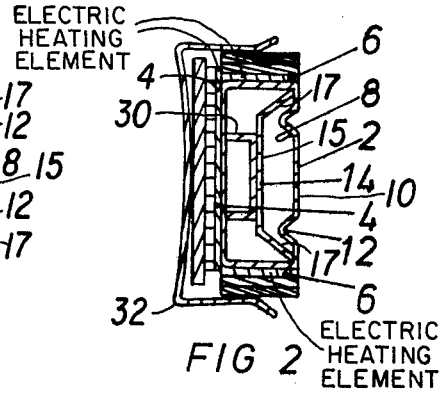
FIG. 2 is a cross-section along A—A of FIG. 1.

With reference to FIGS. 1 to 6 a yarn heater comprises an elongate hollow yarn heating member 2 having a substantially constant rectangular internal cross-section as shown in FIGS. 2 and 3. At one end of the member 2, which end is in use the lower end, heating elements are secured externally to the member 2. One element 4 bears against the back of the member 2 and a pair of elements 6 bear against the longitudinal sides of the member 2. FIG. 4 shows a variation in which the elements 6 have been omitted. A heating fluid such as THERMEX (Registered Trade Mark) is retained in a sealed condition inside an elongate cavity 8 formed by the hollow member 2, between the longitudinal faces thereof. Thermex is obtainable from Imperial Chemical Industries Limited, is a highly pure, volatile substance with a high boiling point and resistant to higher temperatures and is a eutectic mixture of diphenyl and diphenyl oxide in amounts of 26.5 and 73.5 percent, respectively. At the upper end of the member 2, (see FIGS. 5 and 6), is provided a condensor 18 which is connected by a pipe to the cavity 8. A heating surface 10 extends between the ends of member 2 at the front thereof. The surface 10 is formed with a pair of longitudinal grooves 12 for guiding yarn.

Inside the cavity 8 and adjacent the lower end of the member 2 is mounted a baffle 14 (see FIG. 3). The baffle is comprised of an elongate middle portion 15 and flanges 17 on each side thereof and integral therewith, and has an aperture 16 or is interrupted at its lower end. The yarn heating member 2 may be as long as 80 inches (203 cm). Between the upper and lower parts shown in the drawing there is a substantial length of the heating member not shown for convenience. The intermediate portion contains a temperature sensor for sensing the vapour temperature and a thermal cut-out for disconnecting the heating elements if the temperature exceeds a certain level. At the back the member 2 has pins to enable it to be firmly mounted along its length.

The baffle 14 is inserted during manufacture into the cavity 8. The end of the cavity 8 is closed by forcing the opposing portions of the member 2 together. The baffle 14 is provided with feet 28 which are clamped between the opposing portions to firmly locate the baffle 14. The baffle 14 is spaced from the rear of the cavity 8 opposite the heating element 4 by U-shaped spacer devices 30 welded to the baffle 14. The devices 30 are aligned lengthwise with respect to the member 2 so as to facilitate lengthwise flow past the baffle 14. The baffle 14 has curved lengthwise extending portions engaging in the corners of the cavity 8 so as to locate the elements 6 if present behind the baffle 14. The devices may have diverging legs as shown in FIG. 4 to urge the baffle 14 to the heating surface 10.

The condensor 18 is arranged behind the member 2 and can contain a vapour or gaseous phase at a level slightly above the uppermost yarn engaging portion of the grooves 12. The condensor has at its upper part a fill tube 20 which includes a length of tube which can be clamped and welded to seal the inside of the condensor 18 and the cavity from atmosphere. The fill tube can be opened by removing the welded portion and then be resealed by clamping and welding at a lower level of the tube 20.

The heating elements 4, 6 are urged against the sides of the member 2 by clips 32. The member 2 and the heating elements 4, 6 are supported in lagging 34 inside a can 36 by brackets 38 permitting lengthwise expansion of the member 2. Clips 40 hold insulating material against the edges of the heating surface 10 and removable lid 42 secured to the can 36 covers the heating surface 10.

The yarn heating member 2 is prepared for use by introducing a heating fluid through the fill tube 20 and taking steps to remove all impurities for example by heating the fluid to expel all other vapours or gases and then sealing the fill tube 20. Remnants of impurities or products of thermal decomposition of the heating fluid produced in use can be stored in the condensor 18 without influencing the action of the heating fluid inside the cavity 8.

In use the heating liquid will rise from a height level with the top of the heating elements 4, 6 about 8 inches long, to a height below the top of the baffle about 11 inches long. The expansion is the result of heat expansion and bubbles with heating fluid vapour in the liquid. It is important that the liquid covers the whole of the area heated by the heating element to prevent local overheating. To provide a sufficient heating capacity for the yarn heating member a sizeable column of liquid must be present next to the heating element.

In use, the heating elements will heat the liquid phase of the fluid in the lower end of the cavity and cause it to boil. The height of the column of liquid increases the boiling temperature of the liquid towards the lower end compared with liquid further up. The baffle 14 represents a particularly simple and effective device for ensuring that the resultant local temperature increase cannot readily be conducted to the heating surface 10. The vapour evaporated rises in the cavity 8. Yarn passing through the grooves 12 tends to cool it and leads to condensation on the walls of the cavity 8 mainly at the front. The condensate flows thus down mainly in front of the baffle 14. Consequently a circulation of liquid results down in front of the baffle 14, through the aperture 16 and up past the heating elements 4, 6. An even temperature may thus be maintained along the length of the heating surface even though part of the surface is heating through a liquid and not vapour phase and though a high column of liquid is heated from behind the yarn heating member 2.

Figure 8:
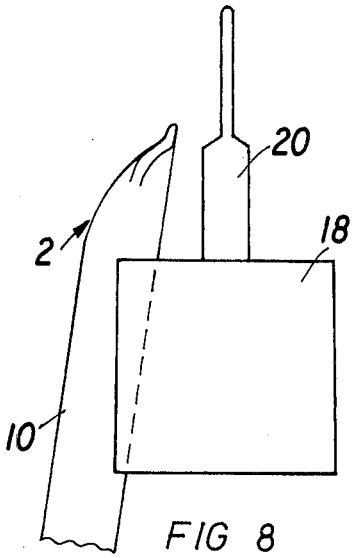
FIG. 8 is a side view of the upper part of another yarn heating member according to the invention.
Figure 1:
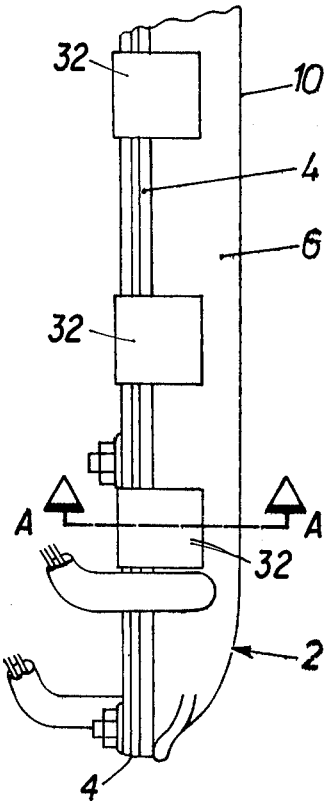
FIG. 1 is a side view of the lower part of a yarn heating member of a yarn heater according to the invention.
Figure 5:
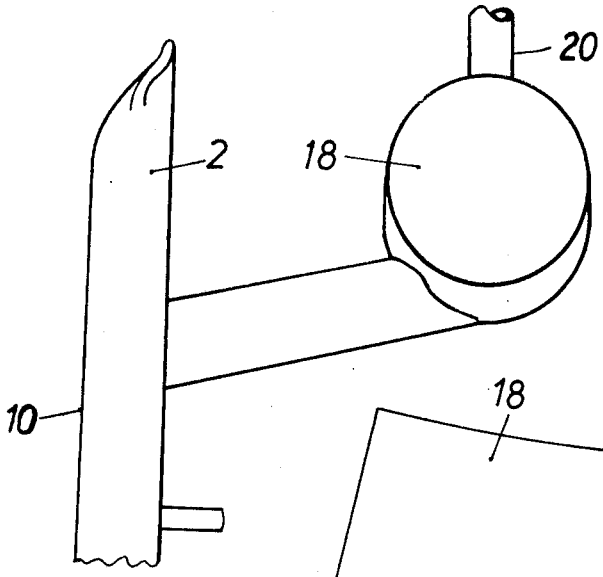
FIG. 5 is a side view of the upper part of the yarn heating member of FIG. 1.
Figure 6:
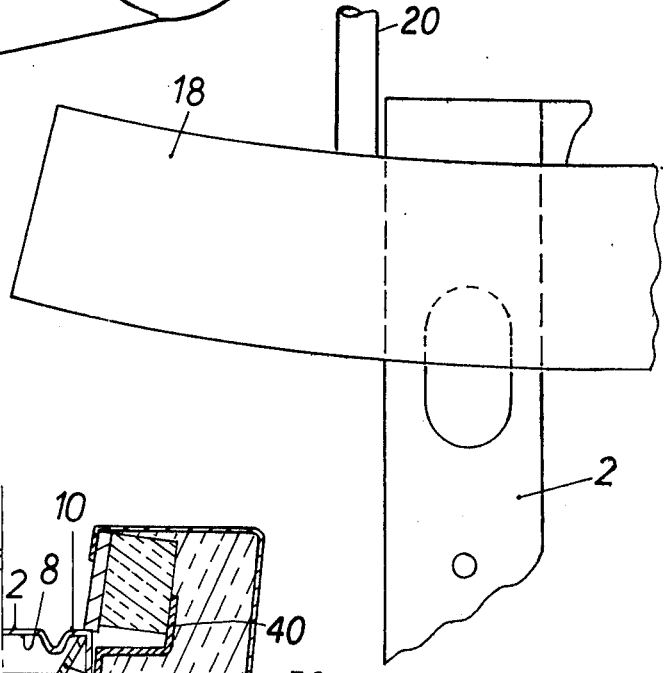
FIG. 6 is a rear view of the upper part of the yarn heating member of FIG. 1.
Figure 7:
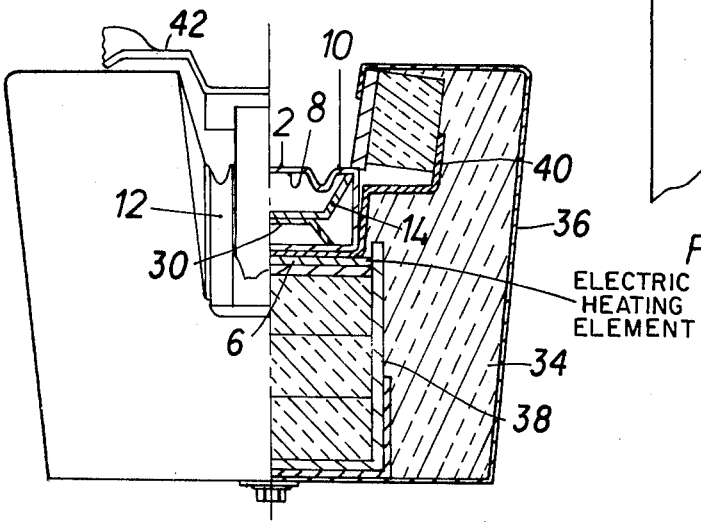
FIG. 7 is an end view partly in section of a yarn heating member of FIGS. 1,2,3,5 and 6, incorporated in a yarn heater.

The yarn heater may be modified by constructing the condensor 18 integrally with the member 2 as shown in FIG. 8. The condenser removes the gaseous impurities from the top of the yarn heating member and assists in preserving a desired temperature at this location also.

I claim:

1. Yarn heater including a single elongate, hollow metal yarn heating member having a substantially constant internal cross-section;

a flat, plate-like electric yarn heating element mounted externally at a lower part of the heating member in heat exchange relationship therewith and extending longitudinally along the rear of the lower part of the heating member;

a yarn heating surface defined by the front of the heating member and extending along the length thereof;

a baffle located internally of the heating member and comprised of an elongate middle portion and elongate flanges on each side of the middle portion and integral therewith, said baffle being substantially coextensive at the upper end thereof with the upper end of said heating element;

spacing means for locating the baffle, the middle portion being located in spaced relation to the front and rear of the heating member and extending longitudinally therein between the yarn heating element and the yarn heating surface in the lower part of the heating member, the flanges being seated against inside surfaces of the heating member by the spacing means;

and means at the lowermost portion of the heating member for defining a restrictive opening for fluid communication between the front and rear of the heating member;

the heating member being filled with heating fluid which consists of when heated a liquid phase and a vapor phase above the liquid phase, the liquid phase having a level at least as high as the top of the yarn heating element and being in heat exchange relationship with the yarn heating element to the rear of the baffle, and with the front of the lower part of the heating member to the front of the baffle, and the vapor phase being in a heat exchange relationship with the front of the heating member above the lower part thereof.

2. Yarn heater as claimed in claim 1 wherein a vessel is provided at the rear of an upper part of the member and a pipe connects the interior of the member to the vessel for containing of gases.

3. A yarn heater as claimed in claim 1 wherein the yarn heating member has a substantially rectangular transverse cross-section.

* * * * *